US007695338B2

(12) United States Patent
Dooley et al.

(10) Patent No.: US 7,695,338 B2
(45) Date of Patent: Apr. 13, 2010

(54) REMOTE CONTROLLED TOY

(75) Inventors: Mike Dooley, San Rafael, CA (US); Gaute Munch, Langå (DK); Jesper Rasmussen, Bredsten (DK)

(73) Assignee: Lego AS, Billund (DK)

( * ) Notice: Subject to any disclaimer, the term of this patent is extended or adjusted under 35 U.S.C. 154(b) by 1562 days.

(21) Appl. No.: 10/953,653

(22) Filed: Sep. 29, 2004

(65) Prior Publication Data

US 2005/0042971 A1 Feb. 24, 2005

Related U.S. Application Data

(62) Division of application No. 09/890,417, filed on Jan. 18, 2002, now Pat. No. 6,814,643.

(51) Int. Cl.
*A63H 33/04* (2006.01)

(52) U.S. Cl. ..... 446/91; 446/175; 446/454

(58) Field of Classification Search ..... 446/175, 446/454, 455–456, 85, 91

See application file for complete search history.

(56) References Cited

U.S. PATENT DOCUMENTS

| | | | | |
|---|---|---|---|---|
| 5,452,901 | A * | 9/1995 | Nakada et al. | 446/454 |
| 5,724,074 | A * | 3/1998 | Chainani et al. | 345/474 |
| 6,083,104 | A * | 7/2000 | Choi | 463/6 |
| 6,206,745 | B1 * | 3/2001 | Gabai et al. | 446/91 |
| 6,902,461 | B1 * | 6/2005 | Munch et al. | 446/91 |
| 6,939,192 | B1 * | 9/2005 | Munch et al. | 446/91 |

* cited by examiner

*Primary Examiner*—Peter DungBa Vo
*Assistant Examiner*—Alex F. R. P. Rada, II
(74) *Attorney, Agent, or Firm*—Day Pitney LLP

(57) ABSTRACT

A toy construction set comprising a first toy construction element configured to resemble a toy construction element and toy construction elements which contains electronic units controllable from said first element, wherein the elements form an integrated toy structure when incorporated therein. The first toy construction element has means, integrated within it, for programming the element by means of a user interface and for storing a program to provide controlled actions of the structure within which it is incorporated. Additionally, the first toy construction element is configured to transmit the program as a download program to a second construction toy.

11 Claims, 7 Drawing Sheets t1: 0.3 s
t2: 1.2 s
T: 10 s
d: +/- 50%

REMOTE CONTROLLED TOY

CROSS-REFERENCE TO RELATED APPLICATION

This is a divisional application of U.S. patent application Ser. No. 09/890,417, filed Jan. 18, 2002, now U.S. Pat. No. 6,814,643.

BACKGROUND OF THE INVENTION

The present invention relates to a remote controlled toy element for remote control by means of signals from a remote control unit, said toy element comprising a sensor which can detect the signals, and at least one unit which is controlled by a microprocessor in response to a program which is executed by the microprocessor, said program comprising program steps.

Such toy elements are widely used and are known e. g. from the product ROBOTICS INVENTION SYSTEM from LEGO MINDSTORMS, which is a toy that can be programmed by means of a computer to perform conditional as well as unconditional actions.

Such toy elements are unique in that programs or other forms of instructions are transferred to the toy by means of a form of communications protocol. Typically, the communications protocol will be adapted to transfer data to the toy in the fastest possible and simultaneously most error-free manner to achieve a good and fast response.

It is a problem with such a toy, however, that the full play potential is not utilized fully.

Accordingly, an object is to provide new play possibilities with an electronic toy.

SUMMARY OF THE INVENTION

This is achieved when the toy element mentioned in the opening paragraph is characterized in that the toy element is adapted to record pulse patterns containing pulses which have flanks with intervals that are longer than the response time of a human being, and to control the unit in various ways by selecting a program step in response to a recorded pulse pattern.

It is ensured hereby that the toy element can be remote controlled by sound or particularly by light. Remote control by light takes place in that a user signals with e. g. an ordinary hand-held lamp which is driven by batteries or by the mains. The signalling takes place in that the user manually turns the lamp on and off and thereby produces pulses of visible light with a predetermined sequence of short and long pulses and intervals. The signalling may also take place by means of sound pulses, which may e. g. be produced in that the user claps his hands or whistles or sings a specific sequence of short and long pulses and intervals.

BRIEF DESCRIPTION OF THE DRAWINGS

The invention will now be described with reference to the drawing, in which.

DETAILED DESCRIPTION OF THE PREFERRED EMBODIMENTS

Figure 1:
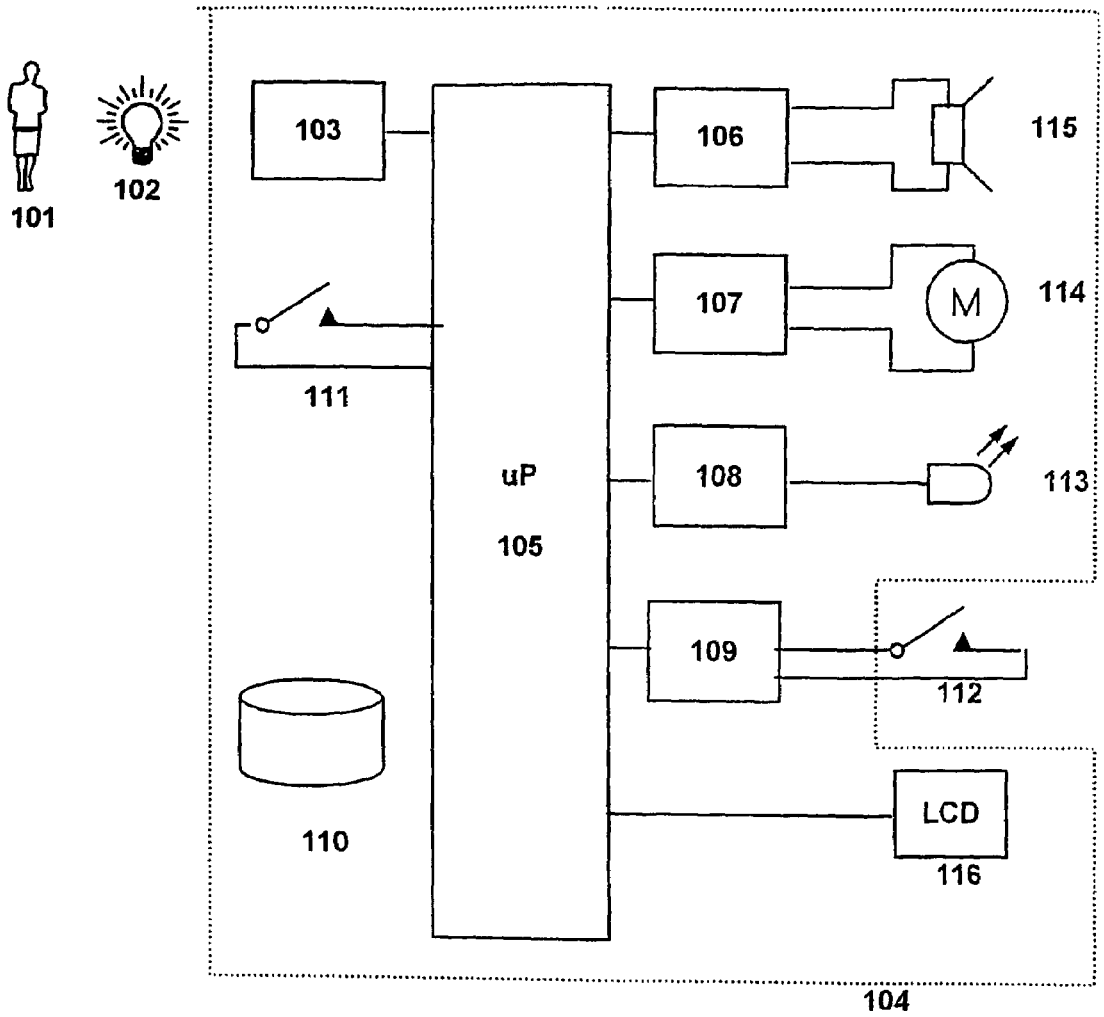
FIG. 1 shows a block diagram of a remote controlled toy element for remote control by means of signals from a remote control unit and for control of units.

FIG. 1 shows a block diagram for a remote controlled toy element for remote control by means of signals from a remote control unit and for control of units. A user 101, e. g. a playing child, can operate a signal generator, e. g. a pocket torch 102. The pocket torch can be operated by alternately turning the torch on and off or by moving the cone of light of the torch. The cone of light may be directed toward a light detector 103. The light detector may be positioned behind a protecting light permeable plate in a toy element 104. The toy element may e. g. be a building element which can be connected with other building elements of the same or another type. The detector 103 can emit a signal in response to the light which it receives. The signal may be an analogue signal which depends on the light intensity which falls on the light detector or merely be a simple on/off signal. The toy element 104 comprises a microprocessor 105 which can perform one or more programs stored in the memory 110. The microprocessor 105 is connected to a number of units for transmitting and receiving signals. A first unit 109 can receive signals on external mechanical impacts e. g. from a switch 112. A second unit 108 can emit light signals via a lamp or light diode 113. A third unit 107 can control a motor 114. A fourth unit 106 can emit sound signals via a sound generator 115 e. g. a loudspeaker or a piezoelectric element. Moreover, the microprocessor 105 can control an LCD display 116. The switch 111 can be used for selecting a state of the microprocessor 105 so that a specific subset of program steps can be selected from a set of program steps It is thus possible to combine the above-mentioned elements/units so that the toy element may be incorporated in a structure such as e. g. a car or another vehicle or a movable figure, the structure being composed of elements in construction toy set.

Figure 2:
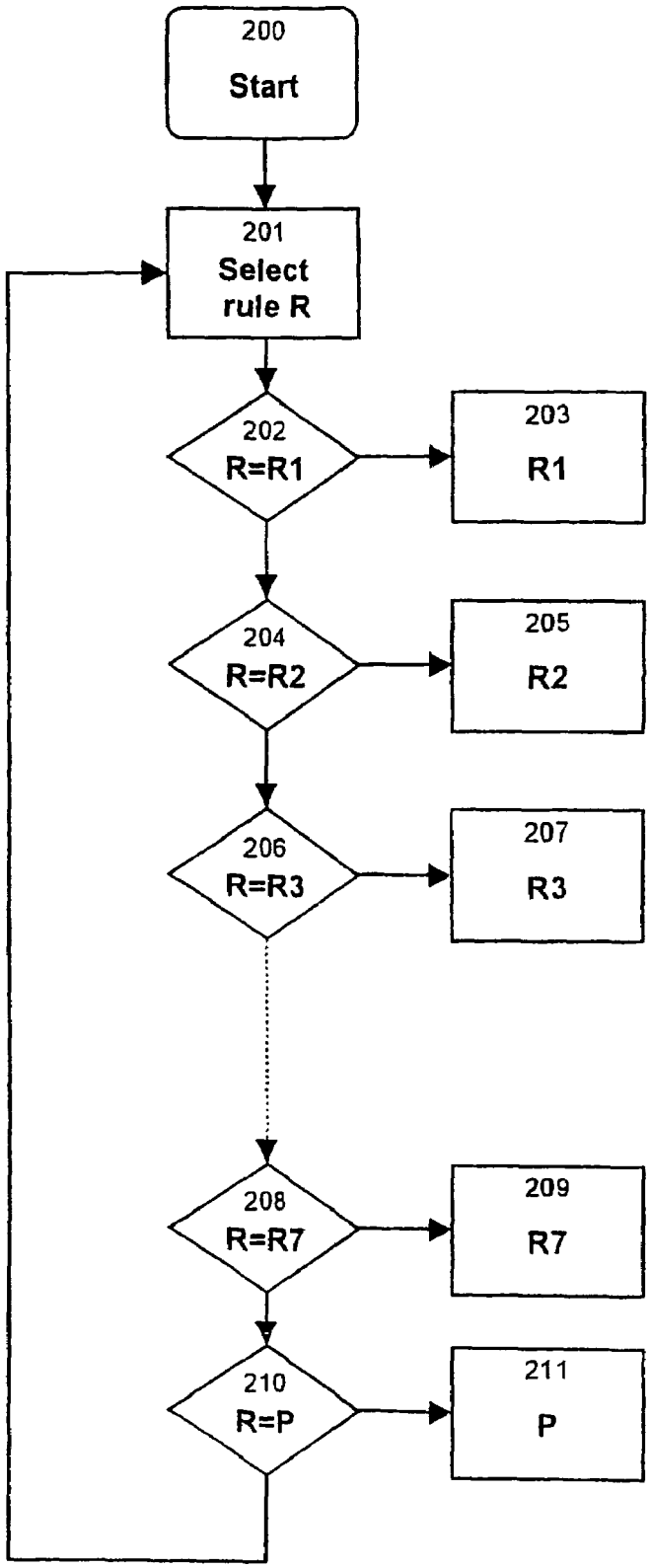
FIG. 2 shows a flow chart for a program for selecting a subset of program steps from a set of program steps in response to an operation selection.

FIG. 2 shows a flow chart for a program for selecting a subset of program steps from a set of program steps in response to an operation selection. The operation selection can e. g. take place by operating the switch 111. The flow chart starts in step 200. Then a subset of program steps is selected. A subset of program steps is also called a rule. In 201, rule R is selected from a collection of predetermined rules R1-R7 in the form of rule based programs stored in the memory 110. It is decided in step 202 whether the selected rule is rule R=R1. If this is the case (yes), the rule based program R1 is executed in step 203. Alternatively (no), it is checked whether rule R=R2 was selected. Correspondingly, it is decided in steps 204, 206 and 208 whether the selected rule is rule 2, 3 or 7, and respective rule based programs are executed in steps 205, 207 or 209. It is thus possible to select one of several predetermined rules. These rules may e. g. be determined by the manufacturer of the toy element.

However, it will also be possible to store user defined rules by combining the predetermined rules. This will be mentioned below in connection with the description of FIG. 7.

Figure 3:
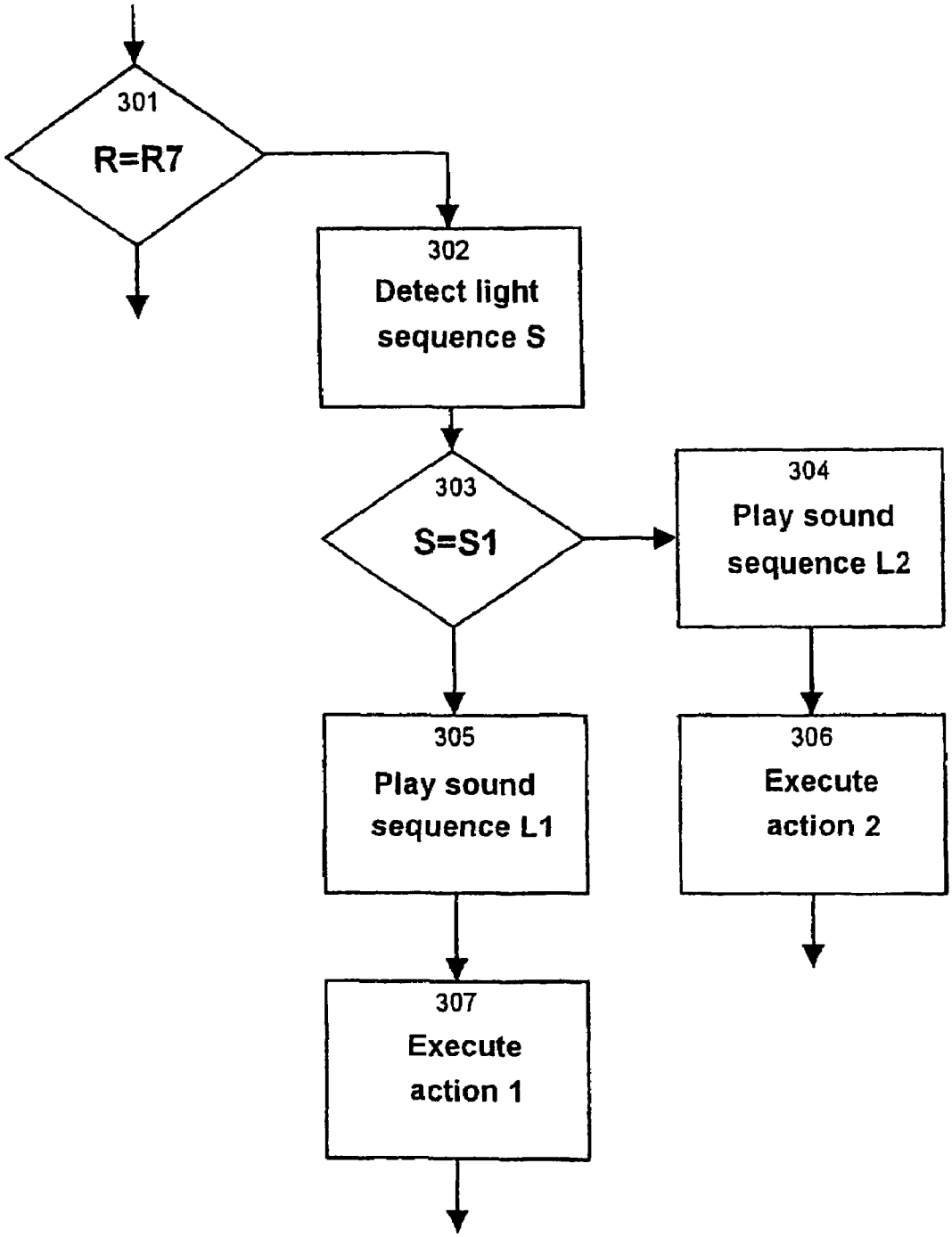
FIG. 3 shows a flow chart for a program for controlling a unit in various ways by selecting a program step in response to a recorded pulse pattern.

FIG. 3 shows a flow chart for a program for controlling a unit in various ways by selecting a program step in response to a recorded pulse pattern. An audio/visual signal may be emitted in response to the recorded pulse pattern as a receipt for the reception of the pulse pattern. The pulse pattern may be generated by flashing a pocket torch.

Step 301 corresponds to step 208 in FIG. 2. In step 302, a pulse pattern is detected, consisting of e. g. a pulse of 1 second's duration, a pause of 1 second, a pulse of 1 second's duration, a pause of 1 second's duration, and a pulse of 3 second duration.

It is decided in step 302 whether the pulse pattern is a known pulse pattern (e. g. stored together with other pulse patterns in the memory 110). If the pulse pattern is a known pattern S1 (yes), an audio or visual signal LI recognizable by the user is played in step 305. An audio signal may e. g. be played by means of a piezoelectric element. The user can hereby receive a receipt of recognition of the command. This may be part of the play with the toy element. The user may be rewarded in step 307 in that the toy element performs a given action by executing a sequence of commands in the microprocessor 105.

Alternatively, if the light sequence was not recognized in step 303, another sound sequence L2 may be played in step 304. Subsequently, the toy element may perform an action corresponding to a wrong answer. Examples of possible functions of a number of rule based programs R1-R7 are given below (rule 1, rule 2, rule 3, rule 4, rule 5, rule 6 and rule 7).

Rule 1:
1) A pause of 1 second.
2) A sound sequence (start sound) is played.
3) A pause of 0.5 second.
4) A sound sequence (backward sound) is played.
5) The motor runs backwards for 5 seconds.
6) The motor stops.
7) Points 3-6 are repeated twice (3 times in all).
8) The rule is stopped.

Rule 2:
1) A pause of 1 second.
2) A sound sequence (start sound) is played.
3) A pause of 0.5 second.
4) A sound sequence (backward sound) is played.
5) The motor runs backwards for 5 seconds.
6) The motor stops.
7) A pause of 0.5 second.
8) A sound sequence (forward sound) is played.
9) The motor runs forwards for 5 seconds.
10) The motor stops.
11) Points 3-10 are repeated twice (3 times in all).
12) The rule is stopped.

Rule 3:
1) A pause of 1 second.
2) A sound sequence (calibrate sound) is played.
3) A sound sequence (start sound) is played.
4) A sound sequence (backward sound) is played.
5) The motor runs backwards for max. 7 seconds.
6) If light is detected before the 7 seconds have elapsed (point 5):
   The motor stops.
   Forward sound sequence is played.
   The motor runs forwards as long as light is detected.
   If light disappears:
   i. The motor stops after 0.5 second.
   ii. If the light comes back within 2 seconds, the motor starts again.
   iii. If the light is out for 2 seconds, then the motor remains turned off.
7) Points 4-6 are repeated as long as light is detected within the 7 seconds and until 3 attempts without light have been made.
8) The motor stops.
9) The rule stops.

Example of the user's experience: The model is constructed such that when the model drives backwards the model turns, and when it drives forwards, it drives straight ahead. The rule therefore gives a search light function-when the user throws light on the model, the model drives forwards toward the user.

Rule 4:
1) A pause of 1 second.
2) Motor direction is set for forwards.
3) A sound sequence (calibrate sound) is played.
4) A sound sequence (start sound) is played.
5) When light is detected:
   The motor runs.
6) When dark is detected:
   The motor stops.
7) When 2 flashes are detected:
   The motor direction is changed either from forwards to reverse or from reverse to forwards.
   A sound sequence is played in accordance with the direction of the motor.
8) The rule is stopped 15 minutes after the last light was detected.

Example of the user's experience: The user experiences a remote control. The user can run the motor by constantly throwing light on the model, and change the motor direction by flashing to the model.

Rule 5:
1) A pause of 1 second.
2) A sound sequence (calibrate sound) is played.
3) A sound sequence (start sound) is played.
4) When a flash is detected:
   A sound is played.
   If the motor is off, it is turned on.
   If the motor is on, the speed is increased by one step.
5) If no light is detected:
   If the speed is greater than step 0, the speed is reduced by one step.
   If the speed is step 0, the motor is stopped.
6) The rule stops 15 minutes after the last flash.

Example of the user's experience: The user experiences a form of "keep alive" function. The more and faster flashes, the faster the model runs and the more sounds it plays. If the user does not flash to it, the model "dies".

Rule 6:
1) A pause of 1 second.
2) Motor direction is set for reverse.
3) A sound sequence (calibrate sound) is played.
4) A sound sequence (start sound) is played.
5) When a change in the light level takes place:
   The alarm sound sequence is played.
   The motor runs for 1 second.
   The motor direction is changed.
   The above 3 points are repeated 6 times.
6) The rule is stopped.

Example of the user's experience: The user experiences an alarm function where the user e.g. places a pocket torch which throws light on the model. Then the rule is started, when the light beam from the pocket torch is broken, the alarm sound is played and the motor runs.

Rule 7:
1) A pause of 1 second.
2) A sound sequence (calibrate sound) is played.

3) A sound sequence (start sound) is played.
4) A pause of 1.5 seconds.
5) A long or short tone is played (random).
6) Points 4 and 5 are repeated 2 to 4 times (random). 3 to 5 times in all.

Then the user must send long and short flashes to the model in accordance with the tones.

7) Check flash length:
   Short flash must be less than 0.5 second.
   Long flash must be between 0.5 and 2 seconds.
8) If the length and number of flashes are correct:
   Play sound sequence (correct sound)
   The motor runs forwards for 300 milliseconds.
   The rule stops.
9) If the length and number of flashes are wrong:
   Play sound sequence.
   The motor runs backwards for 300 milliseconds.
   Repeat points 4-7 2 times more and until success.
   If wrong flashes have been given 3 times, a sound sequence (tease sound) is played.
   The rule stops.

Example of the user's experience: 3-5 tones are played for the user. The tones are played in either a short version or a long version. When the user has heard the tones, the user must flash back the length and the number of the tones in the form of light. If the user does this correctly, a success sound is obtained, and the motor runs forwards briefly. If the user does not flash the correct length or number, a sound is played and the motor runs backwards briefly. The user gets 2 more attempts for performing the task (3 attempts in all). If the user is not successful in the 3 attempts, a tease sound is played.

In a preferred embodiment, a given recognizable pulse pattern (S1-S7) can be related to a given sound sequence (L1-L7) so that the user may be informed of the pulse pattern which has been received, and e. g. of the rule or command that will be executed by the microprocessor.

Figure 4:
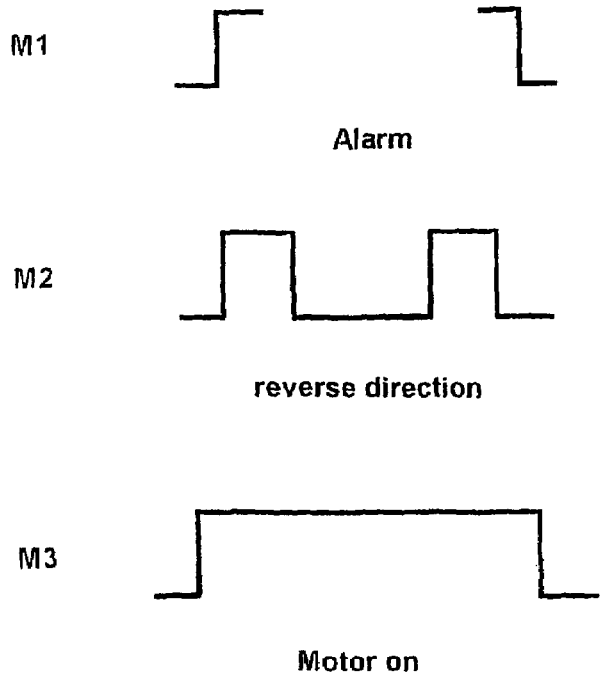
FIG. 4 shows examples of recorded pulse patterns.

FIG. 4 shows examples of recorded pulse patterns M1, M2 and M3. The pulse patterns may be selected in many different ways, provided that they satisfy the condition that characteristics in the form of the duration of two successive flanks for the patterns are generated so that the duration is greater than the human response time. Two successive flanks may be a positive flank followed by a negative flank or two successive positive flanks.

The pulse pattern M1 comprises a positive flank and a negative flank.

The pulse pattern M2 comprises two successive pulses of a relatively short duration, e. g. 400 milliseconds separated by a period of e. g. 700 milliseconds.

The pulse pattern M3 comprises a pulse of a relatively long duration of e. g. 20 seconds.

These pulse patterns may cause a response from the toy element, e. g. as described above.

Figure 5:
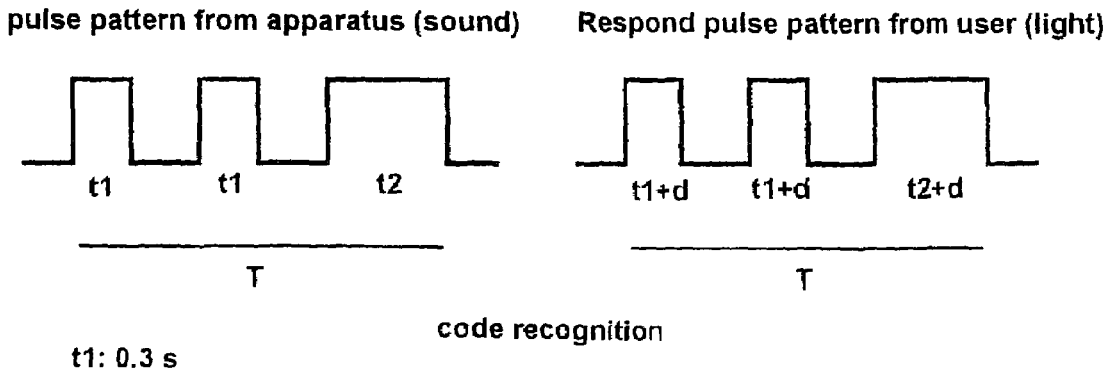
FIG. 5 shows an example of a transmitted pulse pattern and an associated recorded pulse pattern.

FIG. 5 shows an example of an emitted pulse pattern and an associated recorded pulse pattern. This may be an example of a pulse pattern in connection with rule 7 described above. The pulse pattern to the left can indicate playing of two short tones followed by a long tone of durations of t1 and t2, respectively. After playing of the tones, the toy element expects that the user tries to imitate the pattern by generating light pulses with a pattern, that is two short pulses followed by a long pulse.

As it may be difficult for the user, who tries to imitate the pattern, to find the precise length of the emitted pulses and to generate pulses of the same length, it is accepted that the pulses may deviate by a specified deviation d.

Figure 6:
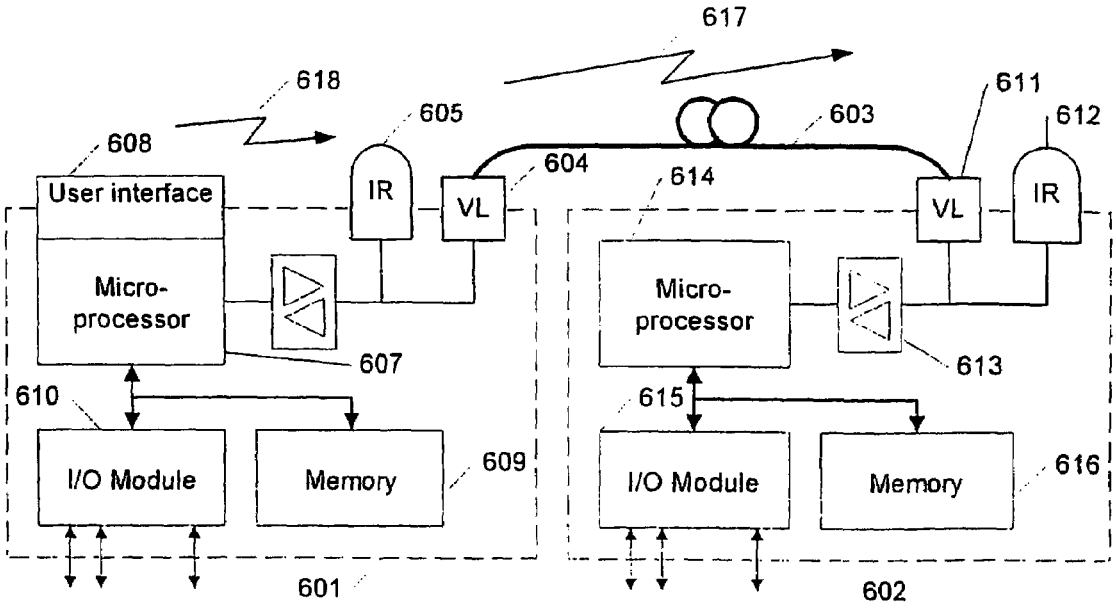
FIG. 6 shows first and second toy elements where the first toy element can transfer data to the second toy element.

FIG. 6 shows first and second toy elements, where the first toy element can transfer data to the second toy element. The first toy element 601 comprises a microprocessor 607, a I/0 module 610, a memory 609 and a user interface 608. The toy element 601 moreover comprises a two-way communications unit 606 for communication with an infrared transmitter/receiver 605 or for communication by means of a light source/light detector 604 which can emit and detect visible light.

Correspondingly, the second toy element 602 comprises a microprocessor 614, a I/0 module 615 and a memory 616. The toy element 602 moreover comprises a communications unit 613 for communication via an infrared transmitter/receiver 612 or for communication by means of a light source/light detector 611 which can emit and detect visible light.

In a preferred embodiment of the invention, the first toy element can both transmit and receive data, while the second toy element can only receive data.

Data can be transferred as visible light via a light guide 603. Alternatively, data may be transferred as infrared light 617 and 618. Data may be in the form of codes that indicate a specific instruction and associated parameters which can be interpreted by the microprocessors 607 and/or 614. Alternatively, data may be in the form of codes which refer to a subprogram or a rule stored in the memory 616.

The I/0 modules 610 and 615 may be connected to electronic units (e. g. motors) for control of these. The I/0 modules 610 and 615 may also be connected to electronic sensors so that the units may be controlled in response to detected signals.

In a preferred embodiment, the fibre 603 is adapted such that part of the visible light transmitted by it escapes from the fibre. It is hereby possible for a user—directly—to watch the transmission. The user can e. g. see when the communication begins and stops.

The light through the fibre can transfer data with a given data transmission frequency as changes in the light level in the fibre. Data may be transmitted such that it is possible for the user to observe individual light level changes during a transmission (that is at a suitably low data transmission frequency) or merely by seeing whether the transmission is going on (that is with a suitably high data transmission frequency).

Generally, it is undesirable that part of the light to be transmitted through the fibre escapes from the fibre. But in connection with communication between two toy elements it is a desired effect, since it is then possible to watch the communication in a very intuitive manner.

It is known to a skilled person how to ensure that part of the light escapes from the fibre. It can e. g. be done by imparting impurities to the sheath of the fibre or by making mechanical notches or patterns in the fibre. The part of the light which is to escape from the fibre may also be controlled by controlling the ratio of the refractive index of a core to that of a sheath of a light guide.

Figure 7:
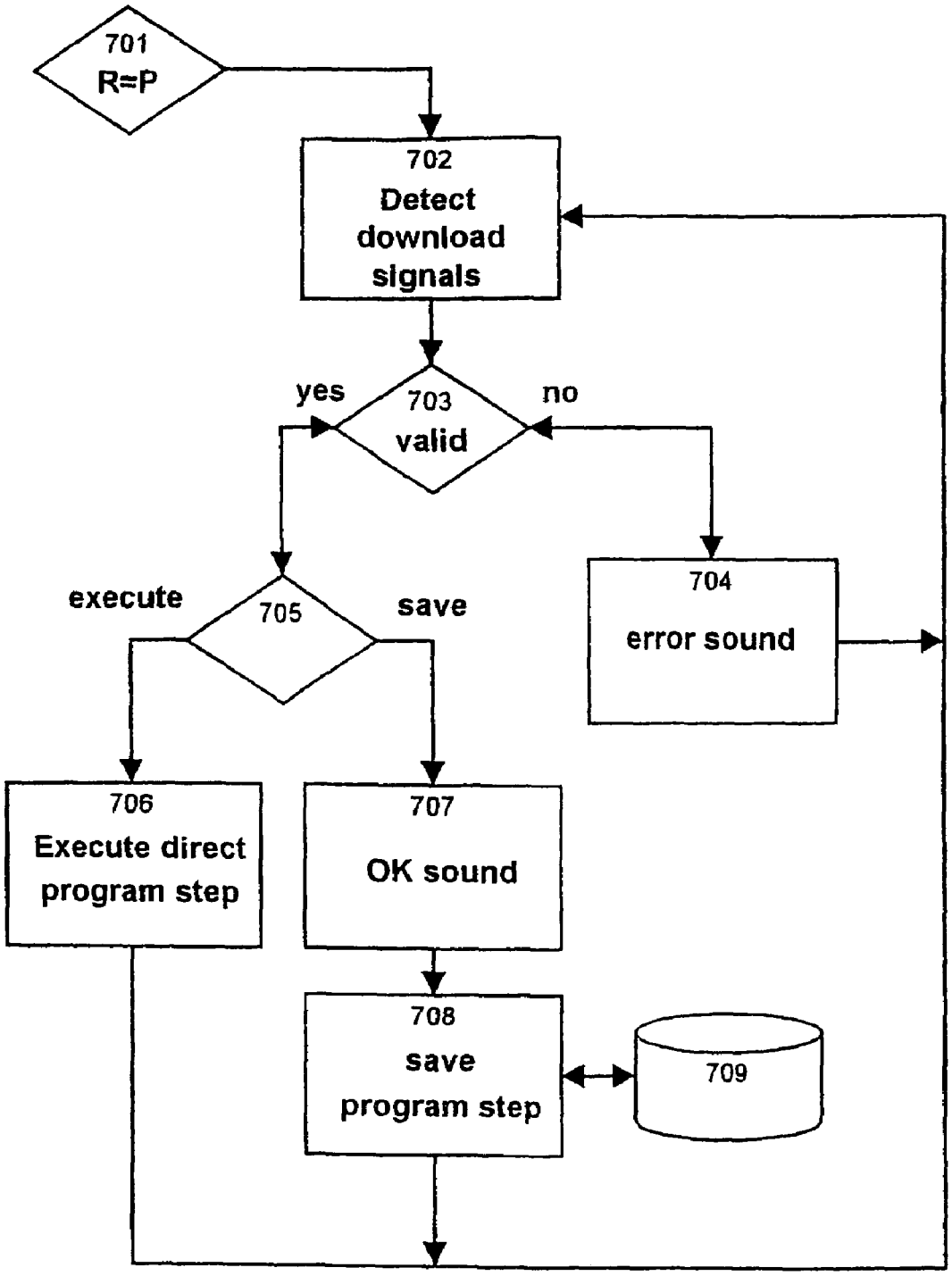
FIG. 7 shows a flow chart for storing program steps.

FIG. 7 shows a flow chart for the storage of program steps. Step 701 corresponds to step 211. The flow chart shows how a user can store own rules transferred from an external unit for e. g. another toy element, as stated above, or from a personal computer. In an embodiment, just references to the rules stored in the toy element are transferred. This reduces the necessary bandwidth for communication between the toy elements. It is checked in step 702 whether download signals are received from external units. If this is the case, it is checked in step 703 whether the download signals are valid. If the signals are not valid (no), a sound indicating an error is played in step 704. If the signals are valid (yes), it is checked whether the signals are to be interpreted as commands which are to be executed at once (execute), or whether the signals are to be interpreted as commands which are to be stored with a view to subsequent execution (save). If the commands are to be executed at once, this is done in step 706, and then the program returns to step 702. If the commands are to be stored, a recognition sound is played in step 707 and the command is stored as a program step in step 708 in the storage 709.

An example of a command to be carried out at once may be that the commands in the storage 709 are to be executed.

In an alternative embodiment, the user's own rules may be formed by making a combination of existing rules without using an external unit.

Figure 8:
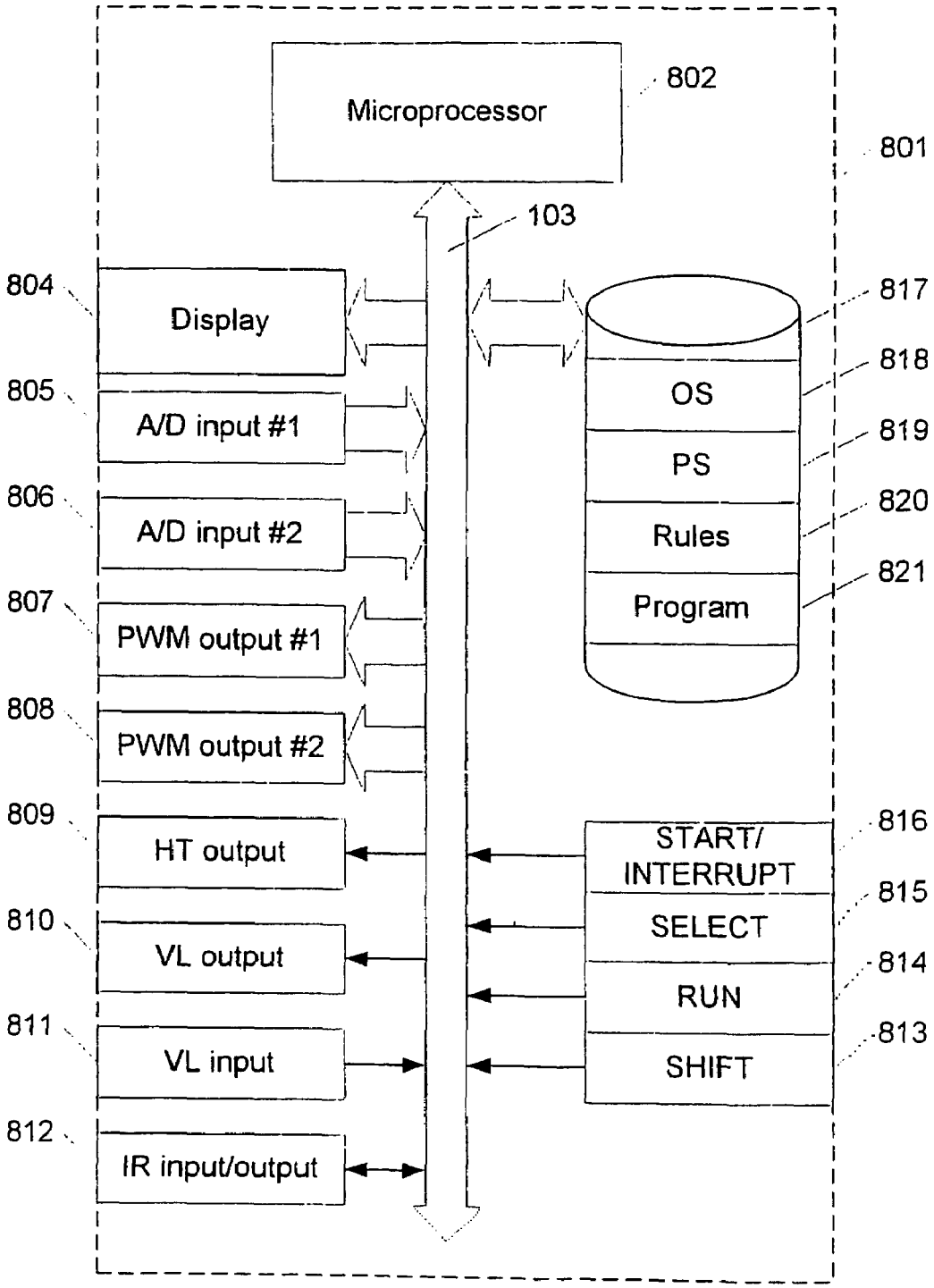
FIG. 8 shows a block diagram for a first toy element which can transfer data to a second toy element.

FIG. 8 shows a block diagram for a first toy element which can transfer data to a second toy element. The toy element 801 comprises a plurality of electronic means for programming the toy element so that it can affect electronic units (e. g. motors) in response to signals picked up from various electronic sensors (e. g. electrical switches).

The toy element may hereby be caused to perform sophisticated functions such as e. g. event-controlled movement, on condition that the toy element is combined with the electronic units/sensors in a suitable manner.

The toy element 801 comprises a microprocessor 802 which is connected to a plurality of units via a communications bus 803. The microprocessor 802 can receive data via the communications bus 803 from two A/D converters "A/D input #1" 105 and "A/D input #2" 806. The A/D converters can pick up discrete multibit signals or simple binary signals. Furthermore, the A/D converters are adapted to detect passive values such as e.g. ohmic resistance.

The microprocessor 802 can control electronic units such as e. g. an electric motor (not shown) via a set of terminals "PWM output #1" 807 and "PWM output #2" 808. In a preferred embodiment of the invention, the electronic units are controlled by a pulse width modulated signal.

Further, the toy element can emit sound signals or sound sequences by controlling a sound generator 809, e. g. a loudspeaker or piezoelectric unit.

The toy element can emit light signals via the light source "VL output" 810. These light signals may be emitted by means of light-emitting diodes. The light-emitting diodes may e. g. be adapted to indicate various states for the toy element and the electronic units/sensors. The light signals may moreover be used as communications signals for other toy elements of a corresponding type. The light signals may e. g. be used for transferring data to another toy element via a light guide.

The toy element can receive light signals via the light detector "VL input" 111. These light signals may be used inter alia for detecting the intensity of the light in the room in which the toy element is present. The light signals may alternatively be received via a light guide and represent data from another toy element or a personal computer. The same light detector may thus have a communication function via a light guide as well as serve as a light sensor for detecting the intensity of the light in the room in which the toy element is present.

In a preferred embodiment, "VL input" 811 is adapted to selectively either communicate via a light guide, or alternatively to detect the intensity of the light in the room in which the toy element is present.

Via the infrared light detector "IR input/output" 812, the toy element can transfer data to other toy elements or receive data from other toy elements or e. g. a personal computer.

The microprocessor 802 uses a communications protocol for receiving or transmitting data.

The display 804 and the keys "shift" 813, "run" 814, "select" 815 and "start/interrupt" 816 constitute a user interface for operating/programming the toy element. In a preferred embodiment, the display is an LCD display that can show a plurality of specific icons or symbols. The appearance of the symbols on the display may be controlled individually, e. g. an icon may be visible, be invisible and be caused to flash.

By affecting the keys, the toy element may be programmed at the same time as the display provides feedback to the user about the program which is being generated or executed. This will be described more fully below. As the user interface comprises a limited number of elements (that is a limited number of icons and keys), it is ensured that a child who wants to play with the toy will quickly learn how to operate it.

The toy element also comprises a memory 817 in the form of RAM and ROM. The memory contains an operating system "OS" 818 for control of the basic functions of the microprocessor, a program control "PS" 819 capable of controlling the execution of user-specified programs, a plurality of rules 820, each rule consisting of a plurality of specific instructions for the microprocessor, and a program 821 in RAM which utilizes the specific rules.

In a preferred embodiment, the toy element is based on a so-called single chip processor which comprises a plurality of inputs and outputs, a memory and a microprocessor in a single integrated circuit.

In a preferred embodiment, the toy element comprises light-emitting diodes which can indicate the direction of rotation of connected motors.

What is claimed is:

1. A toy construction set comprising:

a first toy construction element configured to resemble a toy construction element;

toy construction elements which contains electronic units controllable from said first toy construction element;

wherein the toy construction elements and the first toy construction element form a toy structure when incorporated therein; said first toy construction element has integrated within it;

a storage memory configured to store a program;

a processor to execute the program stored in the storage memory;

a transmitter; and a user interface configured to enter a program for storage in the storage memory and execution by the processor in the first toy element; said program, when executed by the processor, providing control of the toy construction elements to provide controlled actions of the toy structure; wherein the first toy element is configured to transmit the program as a download signal; and a second toy construction element with:

a receiver arranged to receive the download signal, a user interface for operating the second toy element by a choice selection;

a storage memory configured to store the program;

means for executing the program which is configured for execution by the first and second toy element said execution providing program control of electronic units that resemble elements of the toy construction set and are coupled directly to the second toy element; wherein the second toy construction element checks whether the download signal is to be interpreted as commands which are to be executed at once or whether the download signal is to be interpreted as commands which are to be stored for subsequent execution.

2. A toy construction set according to claim 1, wherein the user interface is configured to activate download of a program entered via the user interface.

3. A toy construction set according to claim 1, wherein the user interface is configured to activate download of a program received by download from a personal computer.

4. A toy construction set according to claim 1, wherein program control of construction elements which contains an electronic unit controllable from said first element is provided via an input/output interface.

5. A toy construction set according to claim 1, wherein the transmitter of the first toy construction element is adapted for wireless transmission of signals to the second toy construction element.

6. A toy construction set according to claim 4, wherein the transmitter of the first toy construction element is adapted for transmission of infrared signals.

7. A toy construction set according to claim 1, wherein the microprocessor 105 is connected to a toy construction element for providing at least one of the following: signals on external mechanical impacts, light signals, motor control, sound signals via a sound generator.

8. A toy construction set according to claim 1, wherein sub-programs are stored in the second toy element, and the download signal comprises references to the rules stored in the second toy construction element.

9. A toy construction set according to claim 1, wherein the first toy construction element is caused to perform event-controlled movements when executing a program when incorporated into a structure with elements configured to provide the movements.

10. A toy construction set according to claim 1, wherein the first toy construction element comprises a light detector configured with a dual function of either detecting the intensity of the light impinging on the receiver from the toy element's surroundings or detecting light signals received via a light guide to embody a communications function.

11. A toy construction set according to claim 1, wherein the first toy construction element comprises a display configured to show a plurality of specific icons or symbols: and wherein program are entered by individually controlling the appearance of the symbols on the display.

* * * * *